US005482353A

United States Patent [19]

Lance

[11] Patent Number: 5,482,353

[45] Date of Patent: Jan. 9, 1996

[54] ADJUSTABLE LUMBAR SUPPORTS FOR SEATS

[75] Inventor: Mark A. Lance, Pascoe Vale South, Australia

[73] Assignee: Henderson's Industries Pty. Ltd., Camberwell, Australia

[21] Appl. No.: 150,197

[22] PCT Filed: Jun. 1, 1992

[86] PCT No.: PCT/AU92/00254

§ 371 Date: Dec. 6, 1993

§ 102(e) Date: Dec. 6, 1993

[87] PCT Pub. No.: WO92/21269

PCT Pub. Date: Dec. 10, 1992

[30] Foreign Application Priority Data

Jun. 4, 1991 [AU] Australia ..... PK 6505

[51] Int. Cl.[6] ..... A47C 7/14

[52] U.S. Cl. ..... 297/284.4; 297/284.1

[58] Field of Search ..... 297/284.1, 284.2, 297/284.4, 284.5, 284.8, 230.14

[56] References Cited

U.S. PATENT DOCUMENTS

| | | | |
|---|---|---|---|
| 3,279,849 | 10/1966 | Radke et al. | 297/284.5 |
| 3,905,058 | 9/1975 | Horsfield | 297/284.5 |
| 4,462,635 | 7/1984 | Lance | 297/284 |
| 4,471,993 | 9/1984 | Watson | 297/284.5 |
| 4,957,102 | 9/1990 | Tan et al. | 297/284.8 X |

FOREIGN PATENT DOCUMENTS

| | | | |
|---|---|---|---|
| 0026668 | 4/1981 | European Pat. Off. . | |
| 3600790 | 7/1987 | Germany . | |
| 3620084 | 12/1987 | Germany | 297/284.4 |
| 360516 | 11/1931 | United Kingdom | 297/284.4 |

OTHER PUBLICATIONS

European Search Report, European Patent Office, EP92911324, Mar. 17, 1994.

*Primary Examiner*—Milton Nelson, Jr.
*Attorney, Agent, or Firm*—Evenson McKeown Edwards & Lenahan

[57] ABSTRACT

There is disclosed a lumbar support mechanism for a seat having a bracket adapted to be fixed on one side frame of a seat, a waistband adapted to extend across the seat between the bracket and the other side frame of the seat behind cushioning material of the seat, said bracket including an adjustment device to either alter the distance between the ends of a fixed length waistband or to alter the length of a portion of the waistband extending between the bracket and the other side frame of the seat which includes the improvement of providing a friction reducing device between the cushioning material of the seat and the waistband which friction reducing device extends from the bracket towards the other side frame of the seat.

17 Claims, 1 Drawing Sheet

ADJUSTABLE LUMBAR SUPPORTS FOR SEATS

BACKGROUND OF THE INVENTION

This invention relates to improvements in adjustable lumbar supports for seating and relates particularly but not exclusively to such adjustable lumbar supports for motor vehicles.

The lumbar support is provided by a waistband extending from one side of a seat frame to the other and the variation in support is achieved by altering the length of the waistband supported by two fixed points or by altering the distance between the ends of a fixed length waistband by suitable adjustment means from either or both ends of the waistband. In either case the radius of the arc of the waistband is altered to provide the adjustment or variation of the lumbar support provided for the occupier of the seat.

Examples of known adjustable lumbar support mechanisms incorporating a flexible waistband of inextensible material are described in British Patent 2035792 (Holdsworth); Australian Patent Application No. 80449/82 (Moriya et al), U.S. Pat. No. 4,462,635 (Lance) and international application publication No. WO 92/17096 (corresponding U.S. patent application Ser. No. 08/122,519, filed Sep. 17, 1993). These patents show differing mechanisms for providing adjustable lumbar support by means of a waistband. The Holdsworth and Moriya lumbar supports provide variable lumbar support by altering the distance between the ends of a fixed length waistband whereas Lance provides adjustment by varying the length of the waistband between two fixed anchorage or support points. In each case the variation of the distance between the ends of the fixed length waistband or the variation of the length of the waistband is accomplished by adjustment at or from one end only of the waistband.

As is known, the waistband extends across the seat behind the normal cushioning and other upholstery of the seat. It is customary at the present time to form the cushioning in the form of specially moulded foam plastic material seat squabs in one piece with the lumbar support waistband positioned behind the cushioning material when considered from the position of the occupier of the seat.

It is also customary, to obtain the desired degree of lumbar support, for the adjustment mechanism to be varied whilst the occupier of the seat is seated in the usual position.

It is also known that the length or curvature of the waistband of the Holdsworth, Moriya or Lance adjustable lumbar supports referred to above is biased to the position set by the adjustment means by the weight component of the occupier of the seat which is in the direction of the waistband. This weight component causes contact between the waistband and the cushioning material of the seat.

It has now been found that the nature of the materials of the waistband and the seat cushioning material is such that the friction between them gives the sensation of uneven lumbar support adjustment when the adjustment of the waistband occurs from one end only as is shown by Holdsworth, Moriya and Lance.

Such adjustable lumbar supports give the sensation of providing lumbar support adjustment in a greater degree towards that end of the waistband where the adjustment is being made to either the distance between the ends of a fixed length waistband or to the length of a waistband between two fixed points.

It is believed that the sensation or perception of uneven lumbar support adjustment is due to friction between the cushioning material of the seat and the waistband and the greater relative movement between the cushioning material and the waistband towards that end of the waistband at which adjustment occurs.

It is an object of the present invention to overcome the perceived disadvantages of the prior art adjustable lumbar support devices.

SUMMARY OF THE INVENTION

The present invention therefore, in one preferred form, provides a lumbar support mechanism for a seat having a bracket adapted to be fixed to one side frame of a seat, a waistband adapted to extend across the seat between the bracket and the other side frame of the seat behind cushioning material of the seat, said bracket including adjustment means to either alter the distance between the ends of a fixed length waistband or to alter the length of a portion of the waistband extending between the bracket and the other side frame of the seat which includes the improvement of providing a friction reducing means between the cushioning material of the seat and the waistband which friction reducing means extends from the bracket towards the other side frame of the seat.

The present invention also provides a lumbar support mechanism for a seat having a first bracket adapted to be fixed on one side frame of a seat; a second bracket adapted to be fixed on the other side frame of the seat; waistband adapted to extend between said first and second brackets across the seat behind cushioning material of the seat, said second bracket including adjustment means to either alter the distance between the ends of a fixed length waistband or to alter the length of a portion of the waistband extending between the first and second brackets which includes the improvement of providing a friction reducing means between the cushioning material of the seat and the waistband which friction reducing means extends from the second bracket towards the first bracket.

It will be clear to those skilled in the art that whilst the waistband is described as being adjustable from one end only that greater adjustment may be obtained, for example, by provision of adjustment means on both sides of the seat. Such dual adjustment means may be operated independently or via remote operating means manually or by motor drive.

The present invention also provides a lumbar support mechanism for a seat having an adjustable waistband adapted to extend across the seat between two side frames of the seat behind cushioning material of the seat and including adjustment means to either alter the distance between the ends of a fixed length waistband or to alter the length of a portion of the waistband extending between two side frames of the seat which includes the improvement of providing a friction reducing means between the cushioning material of the seat and the waistband which friction reducing means extends from the bracket towards the other side frame of the seat.

The present invention furthermore also provides a lumbar support mechanism for a seat having a first bracket adapted to be fixed on one side frame of a seat; a second bracket adapted to be fixed on the other side frame of the seat; waistband adapted to extend between said first and second brackets across the seat behind cushioning material of the seat, said first and/or second bracket including adjustment means to either alter the distance between the ends of a fixed length waistband or to alter the length of a portion of the waistband extending between the first and second brackets which includes the improvement of providing a friction reducing means between the cushioning material of the seat and the waistband which friction reducing means extends from one bracket including adjustment means towards the other.

Preferably the friction reducing means is fixed with respect to the cushioning material or the second bracket. Preferably the friction reducing means provides reduced friction between the waistband and the friction reducing means as compared to the friction between the waistband and the cushioning means.

Preferably the waistband is a flexible waistband of relatively inextensible elastic or resilient material. That is to say the material of the waistband may "give" a little on application of abnormal forces over and above those encountered in normal use but returns, due to its elasticity or resiliency to its original configuration when the abnormal forces are removed.

Preferably the friction reducing means extends between the waistband and the cushioning material from the adjustment means bracket, a distance approaching the other side frame of the seat. More preferably the friction reducing means extends from the adjustment bracket to a length up to 80% of the length of the waistband. More preferably the friction reducing means extends from the second bracket to a length at least 50 to 60% of the length of the waistband. The required length of the friction reducing means depends on the degree of perceived uneven lumbar support adjustment due to the degree of friction between the cushioning material and the waistband. The length of friction reducing means may be less than the above quoted 50% depending on the exact nature of the materials of the cushioning material and the waistband and where the adjustment of the waistband is effected by means of an adjustment bracket on both sides of the seat to provide greater adjustment than is easily obtainable with a single adjustment means.

Preferably the friction reducing means comprises a sheet of flexible material which is fixed with respect to the cushioning material of the seat, extends between the cushioning material and the waistband and is of a width greater than the width of the waistband.

The friction reducing material is preferably in the form of a strip of flexible sheet material fixed to the second bracket of the seat. The friction reducing material however may comprise a strip of flexible sheet material attached to the cushioning material by use of adhesive or other suitable means. The flexible sheet material may be made from any suitable metal or synthetic plastics material and is preferably made from a low coefficient of friction material such as polyethylene, polypropylene or the like. Other synthetic plastics materials may equally be used.

Preferably the waistband and the friction reducing material are of the same material. Preferably one or other of the facing surfaces of the waistband and the friction reducing material are scored to retain a gel-like lubricant such as a silicon or TEFLON (polytetrafluuoroethylene compounds) lubricant therebetween to further reduce friction between the waistband and the friction reducing means.

BRIEF DESCRIPTION OF THE DRAWINGS

Preferred forms of the invention will now be described with reference to the accompanying drawings in which.

DESCRIPTION OF THE PREFERRED EMBODIMENTS

Figure 1:
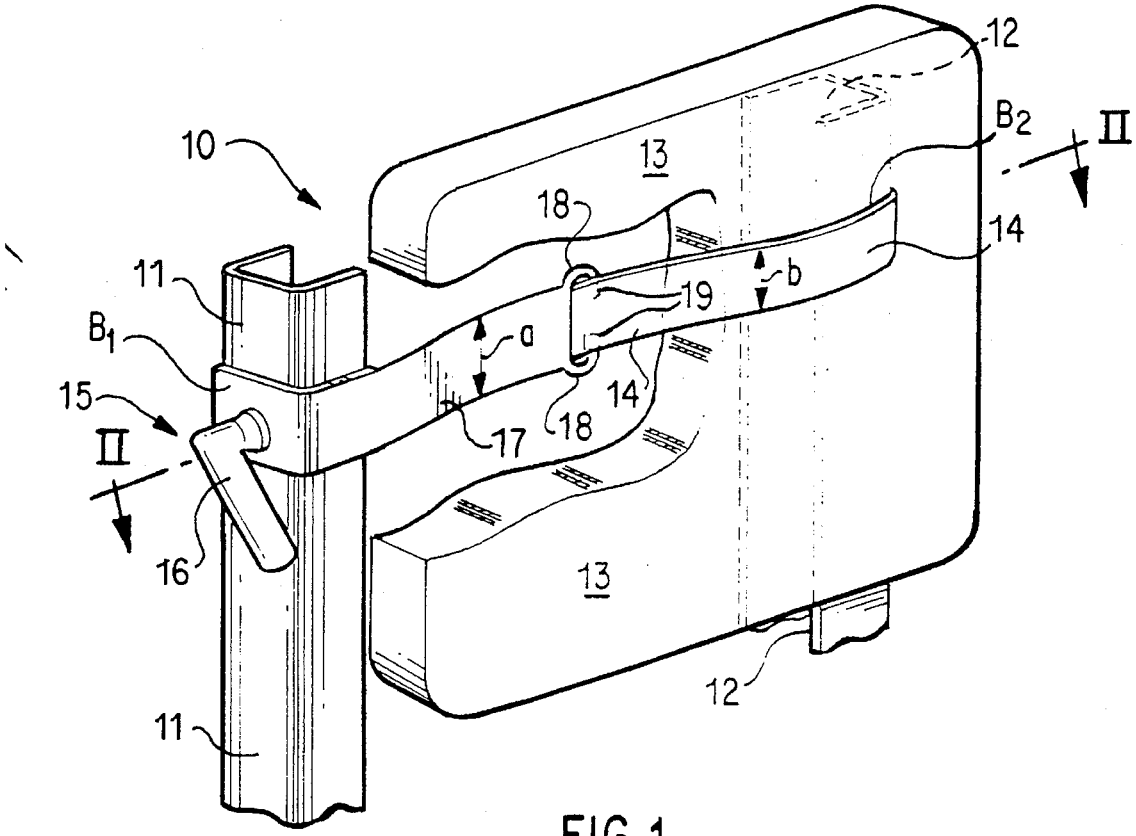
FIG. 1 shows a partial perspective view of a seat lumbar support mechanism in accordance with the invention.
Figure 2:
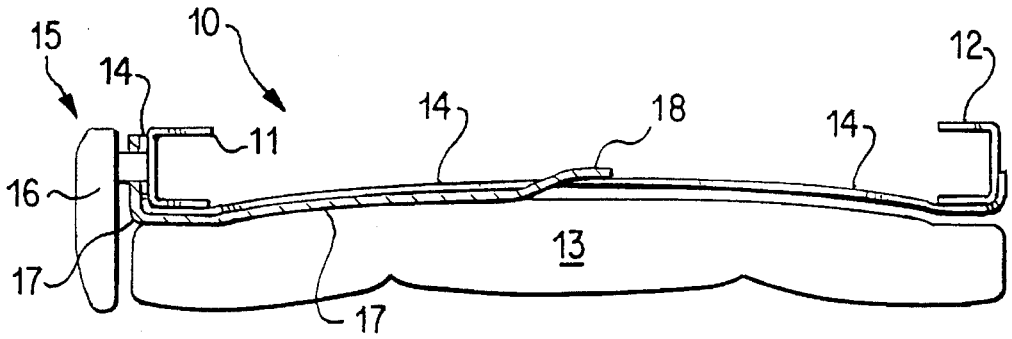
FIG. 2 shows a schematic sectional plan view of the lumbar support mechanism taken along line II—II of FIG. 1.

Referring to the drawings, there is shown a portion 10 of a seat including first 11 and second 12 side frame members, and a seat cushioning material 13 shown in cutaway in FIG. 1. The adjustable lumbar support mechanism of the seat portion 10 includes waistband 14, attached to frame 12, and adjustment mechanism 15 (not shown in detail) attached to frame 11 which may be operated by handle 16 to vary the effective length of the waistband 14 between the seat frames 11 and 12 to provide for variable lumbar support. The details of the adjusting mechanism are not included herein. Disposed between the waistband 14 and the cushioning material 13 is a friction reducing means 17 in the form of a strip of plastics material such as polyethylene. The friction reducing means or intermediate strip 17 is fixed to the frame member 11 by any convenient means such as by means of handle 16 as shown. The width "a" of the strip 17 is greater than the width "b" of the waistband 14 and extends between the waistband 14 and the cushioning material 13 a distance of about 50% of the length of the waistband towards second frame 12. The strip 17 may include a "C" shaped end 18 to assist in maintaining the position of the waistband 14 relative to the strip 17 whilst allowing the waistband 14 to freely pass within the jaw pieces 19 of the end 18 of the strip 17.

Whilst the invention has been described in relation to preferred features, it will be readily apparent that many modifications may be made to the invention as described without departing from the scope of the invention broadly disclosed.

I claim:

1. A lumbar support arrangement for a seat having seat cushioning material disposed between a pair of seat side frames, comprising:

a waistband adopted to extending between the seat side frames behind the seat cushioning material, and for supportingly engaging with the seat cushioning material, wherein the waistband is adopted for use with a waistband length adjusting device that is adopted to be operably engaged with the waistband at one seat side frame for varying the effective length of the waistband to thereby vary the lumbar support position of the seat cushioning material, and friction reducing material for interposing between facing surfaces of the waistband and the seat cushioning material to thereby reduce sliding friction between the seat cushioning material and the waistband during adjusting of said waistband length by the adjusting device.

2. A lumbar support arrangement according to claim 1, wherein said friction reducing material is adopted to be fixed in position with respect to said seat cushioning material.

3. A lumbar support arrangement according to claim 1, wherein said friction reducing material is adopted to be fixed in position with respect to one of said seat side frames.

4. A lumbar support arrangement according to claim 1, wherein the waistband is a flexible waistband of relatively inextensive elastic material.

5. A lumbar support arrangement according to claim 1, wherein said friction reducing material is in the form of a sheet of flexible material.

6. A lumbar support arrangement according to claim 1, wherein said waistband and said friction reducing material are made of the same material.

7. A lumbar support arrangement according to claim 1, wherein said friction reducing material is adopted to extend over a substantial portion of the length of the facing surfaces of the waistband and seat cushioning materials.

8. A lumbar support arrangement according to claim 1, wherein said friction reducing material includes a sheet of flexible material.

9. A lumbar support arrangement according to claim 8, wherein both said waistband and said sheet of flexible material are adopted to be fixed to one of said seat side frames.

10. A lumbar support arrangement according to claim 9, wherein said sheet of flexible material is wider than said waistband along a substantial portion of their facing surfaces.

11. A lumbar support arrangement according to claim 1, wherein said adjusting device is to be supported at one of said seat side frames.

12. A lumbar support arrangement according to claim 11, wherein said friction reducing material is adopted to extend from the adjusting device over a substantial portion of the length of the facing surfaces of the waistband and seat cushioning material.

13. A lumbar support arrangement according to claim 12, wherein said friction reducing material is adopted to extend over more than 50% of the length of the cushioning material.

14. A lumbar support arrangement according to claim 12, wherein said friction reducing material is in the form of a sheet of flexible material.

15. A lumbar support arrangement according to claim 14, wherein said sheet of flexible material is adopted to be fixed to one of said seat side frames.

16. A lumbar support arrangement according to claim 14, wherein said sheet of flexible material is adopted to be fixed to said adjusting device.

17. A lumbar support arrangement according to claim 14, wherein said sheet of flexible material is formed of plastic having a surface with a low coefficient of friction.

* * * * *